US005287877A

United States Patent [19]

Ackroyd

[11] Patent Number: 5,287,877

[45] Date of Patent: Feb. 22, 1994

[54] SEWER DRAIN TRAP PRIMER VALVE

[75] Inventor: Rand H. Ackroyd, Methuen, Mass.

[73] Assignee: Watts Investment Company, Wilmington, Del.

[21] Appl. No.: 986,792

[22] Filed: Dec. 8, 1992

[51] Int. Cl.[5] ..... F16L 55/24

[52] U.S. Cl. ..... 137/118; 137/247.25; 137/549; 137/561 A

[58] Field of Search ..... 137/118, 247.25, 549, 137/561 A

[56] References Cited

U.S. PATENT DOCUMENTS

| | | | |
|---|---|---|---|
| 1,967,644 | 7/1934 | Williams | 137/118 |
| 2,096,287 | 10/1937 | McDougall | 137/118 |
| 2,233,818 | 3/1941 | Matter | 137/512.2 |
| 2,496,465 | 2/1950 | Goss | 137/118 |
| 3,333,597 | 8/1967 | Sullivan | 137/247.25 X |
| 3,422,835 | 1/1969 | Watts | 137/115 |
| 3,583,004 | 6/1971 | Watts | 4/696 |
| 3,633,627 | 1/1972 | Perrott | 138/31 |
| 3,776,269 | 12/1973 | Watts | 137/561 A |
| 4,000,752 | 1/1977 | Miller et al. | 137/118 |
| 4,204,556 | 5/1980 | Sullivan | 137/247.25 X |
| 4,391,295 | 7/1983 | Stipe | 137/522 |
| 4,497,337 | 2/1985 | Mosbrucker et al. | 137/247.25 |
| 4,574,399 | 3/1986 | Sullivan | 137/247.25 X |
| 4,644,972 | 2/1987 | Perrott | 137/883 |
| 4,816,155 | 3/1989 | Linderman et al. | 137/561 A X |

FOREIGN PATENT DOCUMENTS 979781 12/1975 Canada .

*Primary Examiner*—John Rivell

*Attorney, Agent, or Firm*—Fish & Richardson

[57] ABSTRACT

A sewer drain trap primer valve includes a case defining a volume; a flexible diaphragm separating the volume into an upper, water chamber and a lower, sealed, air chamber; a conduit connecting the water chamber with an outlet orifice defined by a lower end of the case; a valve element moveable between a first position and a second position in response to differential of pressure between an inlet, defined by an upper end of the case, and the water chamber; and a check valve that permits flow of water in a direction from the inlet toward the water chamber and restricts flow of water in the opposite direction. The inlet orifice is located between the volume and a source of domestic water. The outlet orifice is located between the volume and a sewer drain trap. The conduit defines a valve seat and, in first position, the valve element engages the seat to restrict flow of water from the water chamber into the conduit. In second position, the valve element is spaced from engagement with the seat to permit flow of water.

5 Claims, 4 Drawing Sheets

SEWER DRAIN TRAP PRIMER VALVE

BACKGROUND OF THE INVENTION

The invention relates to automatic valves for priming sewer line drain traps.

Sewer line drain traps are provided to prevent escape of gas from sewer lines. Typically, an elbow is provided in the sewer line adjacent to a drain, and the elbow is filled with water to prevent flow of gas from the sewer through the elbow. It is well recognized that water in the trap will evaporate over time, thus adversely affecting operation of the trap, so it is important that the trap be charged periodically to maintain the required level of water.

It is desirable that the sewer trap be charged with water automatically. However, such a system typically requires a connection between the sewer drain trap and a source of water, which creates a potential for contamination of the water source by siphoning of sewer water should there be a loss of water supply pressure. Sullivan U.S Pat. No. 4,204,556 sought to address this concern with an automatic primer valve having a case defining an intermediate supply chamber for water to be delivered to the sewer trap in which the biasing force for charging water into the intermediate supply chamber is a volume of air trapped within the upper portion of that chamber. Mosbrucker et al. U.S. Pat. No. 4,497,337 describes a primer valve in which the biasing force for charging water into the sewer trap is a volume of air trapped below a sliding piston.

SUMMARY OF THE INVENTION

According to one aspect of the invention, a sewer drain trap primer valve comprises a case defining a volume, the case having an upper end and a lower end, the upper end defining an inlet orifice for communication of the volume with a source of domestic water, the lower end defining an outlet orifice for communication of the volume with a sewer drain trap, a flexible diaphragm separating the volume into an upper, water chamber and a lower, sealed, air chamber, a conduit member defining a conduit connecting the upper, water chamber with the outlet orifice, the conduit member defining a first valve seat, a valve assembly comprising a first valve element adapted for movement between a first position and a second position in response to differential of pressure between the inlet and the water chamber, in the first position, the first valve element being in engagement with the first valve seat for restricting flow of water from the water chamber into the conduit, and in the second position, the first valve element being spaced from engagement with the first valve seat to permit flow of water from the water chamber into the conduit, and check valve means adapted to permit flow of water in a direction from the inlet toward the water chamber and to restrict flow of water in a direction from the water chamber toward the inlet.

Preferred embodiments of this aspect of the invention may include one or more of the following features. The case defines an orifice connecting the conduit to the exterior of the case in a manner to prevent siphoning of fluid from the sewer drain trap into the conduit. The valve assembly further comprises a second flexible diaphragm and the first valve element is mounted thereupon. Preferably, the check valve means comprises a check valve element mounted upon the second flexible diaphragm, the check valve element being adapted for movement between a first position restricting flow of fluid and a second position permitting flow of fluid in response to differential of pressure across the second flexible diaphragm. More preferably, the check valve means further comprises means for biasing the check valve element toward the first position. The valve assembly further comprises a float element, and the first valve element is mounted thereupon. Preferably, the check valve means comprises a check valve element mounted upon the float element, the case defines a check valve seat, and the check valve element defines a check surface disposed for sealing engagement with the check valve seat when the first valve element mounted upon the float element is in a second position, the check surface being spaced from engagement with the check valve seat when the first valve element mounted upon the float element is in a first position. More preferably, the check valve element comprises a resilient member extending radially about the float element. A volume of air within the lower, sealed air chamber is at an initial predetermined pressure, preferably above atmospheric pressure.

According to another aspect of the invention, a sewer drain trap primer valve assembly comprises a sewer drain trap valve adapted for connection to domestic water piping and an adaptor for connection of the sewer drain trap primer valve with multiple sewer drain traps. The sewer drain trap valve comprises a case defining a volume, the case having an upper end and a lower end, the upper end defining an inlet orifice for communication of the volume with a source of domestic water, the lower end defining an outlet orifice for communication of the volume with a sewer drain trap, a flexible diaphragm separating the volume into an upper, water chamber and a lower, sealed, air chamber, a conduit member defining a conduit connecting the upper, water chamber with the outlet orifice, the conduit member defining a first valve seat, a valve assembly comprising a first valve element adapted for movement between a first position and a second position in response to differential of pressure between the inlet and the water chamber, in the first position, the first valve element being in engagement with the first valve seat for restricting flow of water from the water chamber into the conduit, and in the second position, the first valve element being spaced from engagement with the first valve seat to permit flow of water from the water chamber into the conduit, and check valve means adapted to permit flow of water in a direction from the inlet toward the water chamber and to restrict flow of water in a direction from the water chamber toward the inlet. The adapter comprises a body having an upper portion defining an inlet orifice for communication with a sewer drain trap primer valve and a lower portion defining a plurality of outlets, each outlet adapted for communication with a sewer drain trap.

In preferred embodiments of this aspect of the invention, the sewer drain trap primer valve assembly further comprises a screen member adapted to be disposed within domestic water piping at the inlet of the sewer drain trap primer valve, the screen member having a first surface opposed to water flow direction, the first surface being impermeable to water, and a second surface opposite to the first surface, the second surface defining at least one aperture for flow of water therethrough toward the inlet.

According to another aspect of the invention, a sewer drain trap primer valve comprises a case defining a volume, the case having an upper end and a lower end, the upper end defining an inlet orifice for communication of the volume with a source of domestic water, the lower end defining an outlet orifice for communication of the volume with a sewer drain trap, a flexible diaphragm separating the volume into an upper, water chamber and a lower, sealed, air chamber, a conduit member defining a conduit connecting the upper, water chamber with the outlet orifice, the conduit member defining a first valve seat, a valve assembly comprising a second flexible diaphragm, with a first valve element mounted thereupon, adapted for movement between a first position and a second position in response to differential of pressure between the inlet and the water chamber, in the first position, the first valve element being in engagement with the first valve seat for restricting flow of water from the water chamber into the conduit, and in the second position, the first valve element being spaced from engagement with the first valve seat to permit flow of water from the water chamber into the conduit, and check valve means adapted to permit flow of water in a direction from the inlet toward the water chamber and to restrict flow of water in a direction from the water chamber toward the inlet, the check valve means comprising a check valve element mounted upon the second flexible diaphragm, the check valve element being adapted for movement between a first position restricting flow of fluid and a second position permitting flow of fluid in response to differential of pressure across the second flexible diaphragm, the check valve means further comprising means for biasing the check valve element toward the first position.

In preferred embodiments of this aspect of the invention, the case defines an orifice connecting the conduit to the exterior of the case in a manner to prevent siphon of fluid from the sewer drain trap into the conduit.

According to another aspect of the invention, a sewer drain trap primer valve comprises a case defining a volume, the case having an upper end and a lower end, the upper end defining an inlet orifice for communication of the volume with a source of domestic water, the lower end defining an outlet orifice for communication of the volume with a sewer drain trap, a flexible diaphragm separating the volume into an upper, water chamber and a lower, sealed, air chamber, a conduit member defining a conduit connecting the upper, water chamber with the outlet orifice, the conduit member defining a first valve seat, a valve assembly comprising a float element, with a first valve element mounted thereupon, adapted for movement between a first position and a second position in response to differential of pressure between the inlet and the water chamber, in the first position, the first valve element being in engagement with the first valve seat for restricting flow of water from the water chamber into the conduit, and in the second position, the first valve element being spaced from engagement with the first valve seat to permit flow of water from the water chamber into the conduit, and check valve means adapted to permit flow of water in a direction from the inlet toward the water chamber and to restrict flow of water in a direction from the water chamber toward the inlet, the check valve means comprising a check valve element mounted upon the float element, the case defining a check valve seat, and the check valve element defining a check surface disposed for sealing engagement with the check valve seat when the first valve element mounted upon the float element is in a second position, the check surface being spaced from engagement with the check valve seat when the first valve element mounted upon the float element is in a first position, the check valve element comprising a resilient member extending radially about the float element.

In preferred embodiments of this aspect of the invention, the case defines an orifice connecting the conduit to the exterior of the case in a manner to prevent siphon of fluid from the sewer drain trap into the conduit.

According to another aspect of the invention, an adapter for use with a sewer drain trap primer valve and multiple sewer drain traps comprises a body having an upper portion defining an inlet orifice for communication with a sewer drain trap primer valve and a lower portion defining a plurality of outlets, each outlet adapted for communication with a sewer drain trap.

Objectives of the invention include to provide a sewer drain trap primer valve that will operate reliably and automatically over extended periods of time to maintain the desired level of water in a sewer drain trap; to provide a trap primer valve that will operate in a manner to effectively protect the domestic water supply from contamination by fluid from the sewer line; and to provide a such a trap that is suitable for connection directly to domestic water piping without requiring use of unnecessary fittings, and that is not susceptible to malfunction due to settling of sediment carried in the domestic water supply. Objectives of the invention also include to provide an adapter housing that will permit use of a single trap primer valve to maintain a plurality of sewer traps.

These and other features and advantages of the invention will be seen from the following description of a presently preferred embodiment, and from the claims.

DESCRIPTION OF THE PREFERRED EMBODIMENTS

Figure 1:
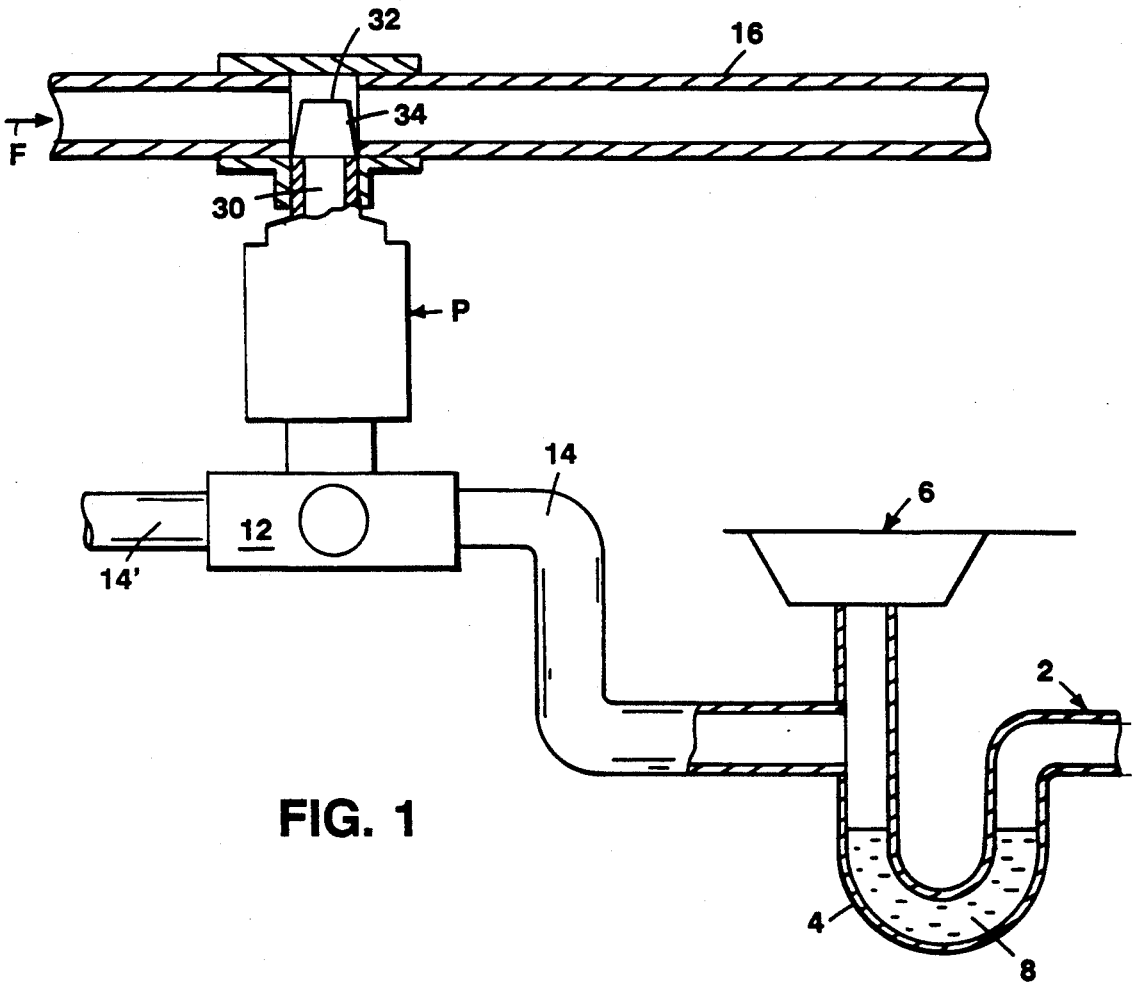
FIG. 1 is a somewhat diagrammatic view of a sewer line equipped with a drain trap primer valve of the invention.

Referring to FIG. 1, a sewer line 2 has a sewer trap 4 adjacent a floor drain 6. The level of water 8 in the trap 4 is maintained automatically by means of a sewer drain trap primer valve, e.g. primer valve P (FIG. 2) or primer valve 60 (FIG. 3) of the invention, which communicates with the trap 2 through a multi-port adapter 12 (also of the invention) and conduit 14. The trap primer valve 10 is connected to a source of pressurized water by domestic water piping 16.

Figure 2:
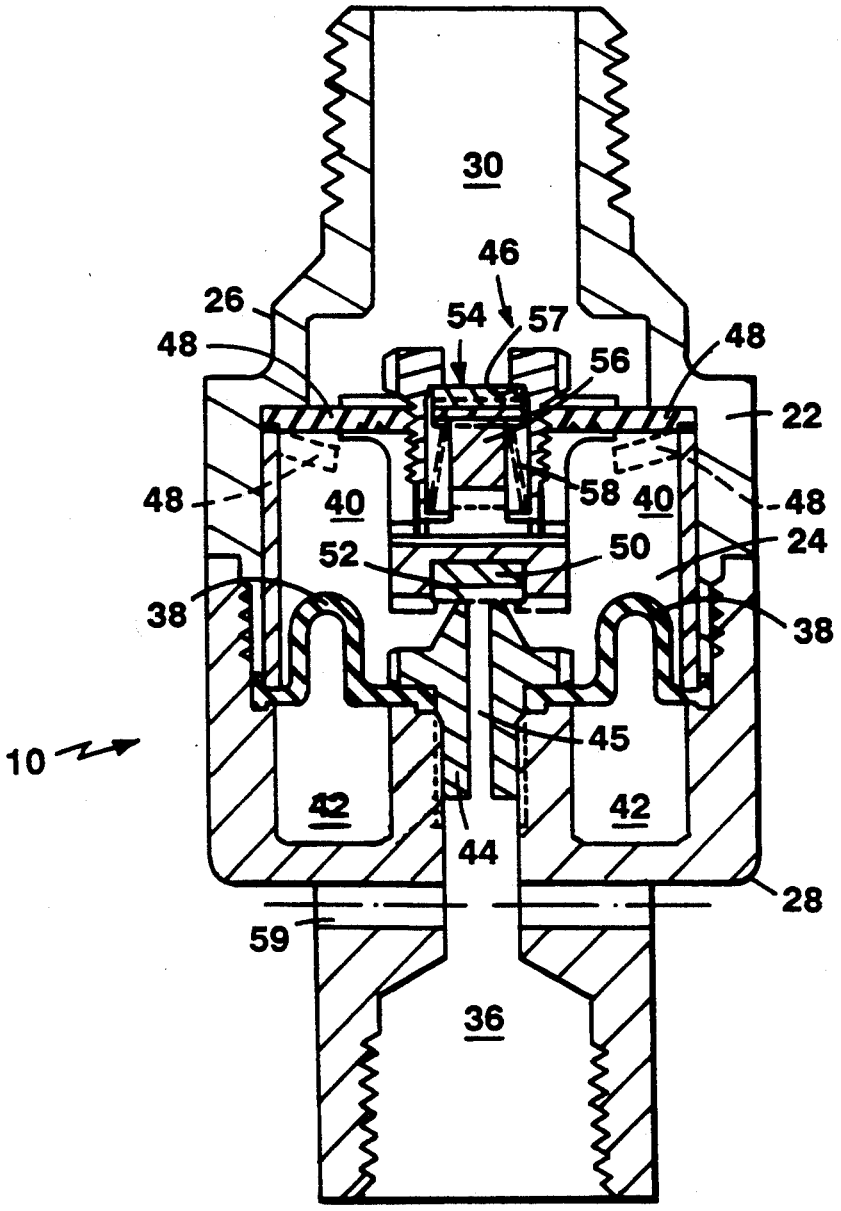
FIG. 2 is a side sectional view of one embodiment of a sewer floor trap primer valve of the invention.

Referring also to FIG. 2, in a first embodiment, the sewer drain trap primer valve 10 of the invention has a case 22 defining a volume 24. The case has an upper end 26 and a lower end 28. The upper end defines an inlet orifice 30 for communication of the volume 24 with domestic water piping 16.

Referring again to FIG. 1, a screen 32 having apertures 34 only in the direction opposite the direction of flow (arrow F) extends into the piping above the inlet orifice 30 to prevent debris carried by the water flowing in piping 16 from entering the trap primer valve 10.

The lower end 28 of the case 22 defines an outlet orifice 36 for communication of the volume 24 with a sewer drain trap 4. A flexible diaphragm 38 separates the volume 24 into an upper, water chamber 40 and a lower, sealed, air chamber 42. A conduit member 44 defines a conduit 45 connecting the upper, water chamber 40 with the outlet orifice 36.

A valve assembly 46 within the case 22 includes a second flexible diaphragm 48 with a first valve element 50 mounted thereupon. The diaphragm 48 is adapted for movement between a first position (indicated in dashed line in FIG. 2) and a second position in response to differential of pressure between the inlet 30 and the water chamber 40. In the first position, the first valve element 50 is in engagement with a first valve seat 52 defined by the conduit member 44 for restricting flow of water from the water chamber into the conduit 45. In the second position (indicated in solid line in FIG. 2), the first valve element 50 is spaced from engagement with the first valve seat 52 to permit flow of water from the water chamber into the conduit.

A check valve assembly 54, mounted upon the second diaphragm 48, permits flow of water in a direction from the inlet 30 toward the water chamber 40 and restricts flow of water in the opposite direction, toward the inlet. The check valve assembly includes a check valve element 56 adapted for movement between a first position (indicate in solid line in FIG. 2) restricting flow of fluid and a second position (shown in dashed line in FIG. 2) permitting flow of fluid in response to a differential of pressure across second flexible diaphragm. The check valve assembly further includes a spring 58 biasing the check valve element 56 toward its first position, into sealing engagement with a check valve seat 57.

The case also defines an orifice 59 connecting the outlet conduit to the exterior of the trap primer valve in a manner to prevent siphoning of fluid 8 from the sewer drain trap 4 into the conduit 45.

Referring again to FIG. 1, the automatic sewer drain trap primer valve P of the invention is installed as in a conduit 14 between domestic piping 16 providing a source of pressurized water and a sewer drain trap 4, with a screen 32 extending into the flow path, F, with the primer valve 10 directly therebelow. (As described above, the screen 32 has apertures 34 only in the direction opposite the direction of flow (arrow F), thereby prevent debris carried by the water flowing in piping 16 from entering the trap primer valve 10.)

The pressure of water entering the valve casing 12 from inlet 30 displaces the second flexible diaphragm 48 toward the dashed line position, causing the first valve element 50 to sealingly engage upon the first valve seat 52. The pressure of water at the inlet also displaces check valve element 56, mounted upon the second diaphragm 48, toward the dashed line position, overcoming the biasing force of spring 58, to allow water to flow into chamber 40. The pressure of water within the chamber 40 also acts upon the first flexible diaphragm 38 to pressurize the sealed volume of air within the chamber 42. (In the preferred embodiment, the volume of air is precharged to a pressure above atmospheric pressure in order to enhance valve performance, especially at higher water pressures.)

When pressure in the domestic piping 16 (and in the inlet 30 to the valve 10) is reduced, e.g. when a faucet is opened, the pressurized air within chamber 42 expands and displaces the first flexible diaphragm toward the water chamber 40. This displacement of the first diaphragm 38 also causes displacement of the second flexible diaphragm 48 toward the solid line position. The check valve element 56 urged also by spring 58, is also caused to move into sealing engagement (solid line) upon check valve seat 57.

Displacement of the second flexible diaphragm 48 removes first valve element 52 from engagement with first valve seat 54 (solid line position), allowing water to flow from the chamber 40 into the conduit 45, and then on to charge the sewer drain trap 4.

When pressure in the chamber 40 falls below the pressure at the inlet 30, the second flexible diaphragm is again displaced toward the dashed line position, causing the first valve element 50 to once again engage upon seat 52 to close the conduit 45, and water from the inlet flows through check valve assembly 54 to recharge the chamber 40.

This process is repeated automatically with each reversal of the pressure differential across the second diaphragm 48 to maintain the desired level of water within the sewer drain trap 4. The domestic water supply piping 16 is protected against contamination since flow from the inlet 30 into the chamber 40 is permitted only when flow into conduit 45 is sealed by first valve 52, and since flow from the chamber 40 into the conduit 45 is permitted only the check valve assembly 54 is closed to prevent flow from the inlet. Also, the check valve assembly 54 serves to restrict backflow from the chamber 40 toward the inlet 30, and the orifice 59 acts to prevent backflow from the sewer drain trap 4 into the valve 10 as might occur due to siphon in the event of sudden loss of supply pressure.

Figure 3:
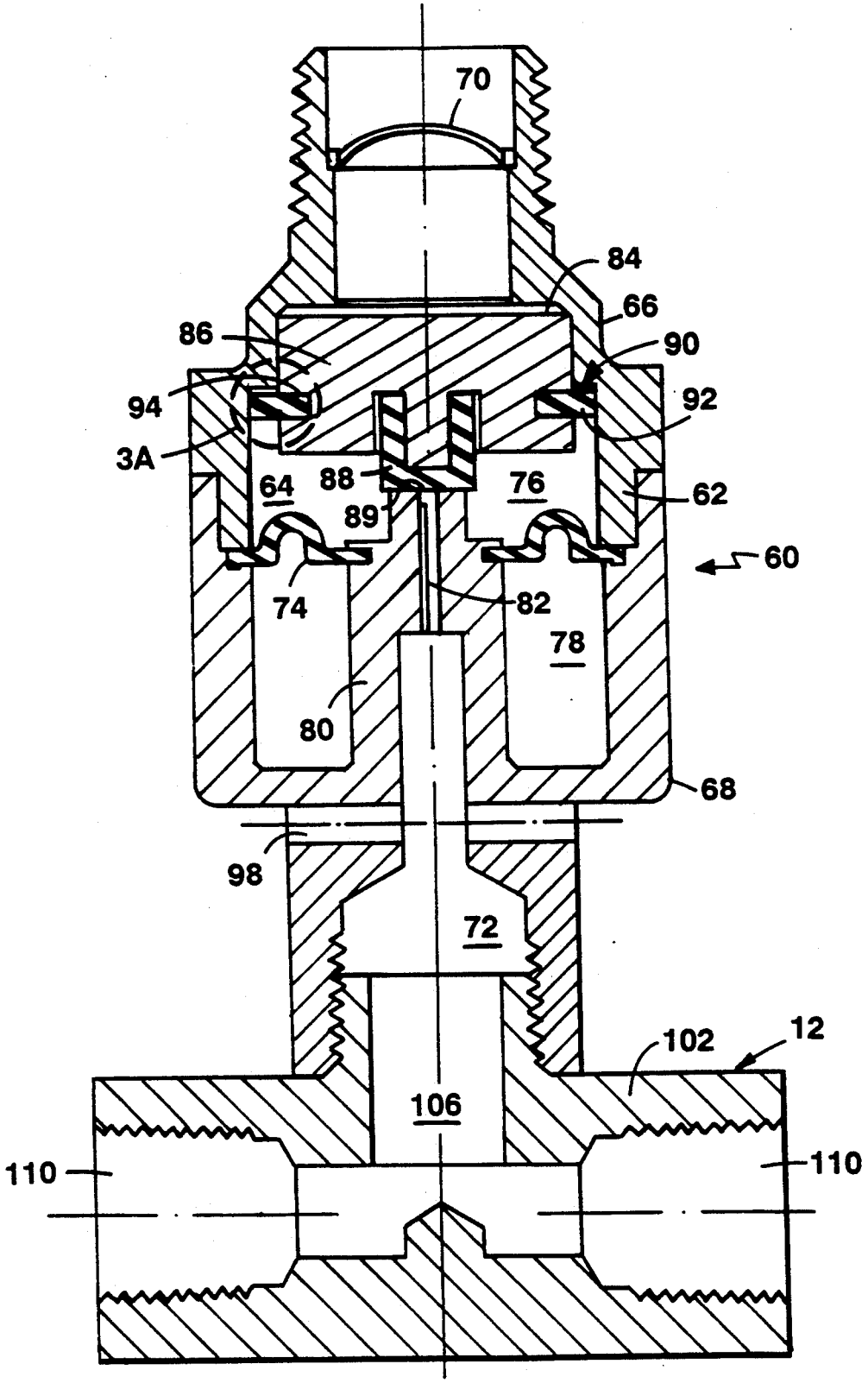
FIG. 3 is a similar view of another embodiment of a sewer floor trap primer valve with a multi-port adapter of the invention.

Referring now to FIG. 3, in another embodiment of the invention, a sewer drain trap primer valve 60 includes a case 62 defining a volume 64. The case has an upper end 66 and a lower end 68. The upper end defines an inlet orifice 70 for communication of the volume 64 with a source of domestic water piping. The lower end defines an outlet orifice 72 for communication of the volume with a sewer drain trap 4. A flexible diaphragm 74, having an outer edge portion fixedly attached to the case between the upper and the lower end, separates the volume 64 into an upper, water chamber 76 and a lower, sealed, air chamber 78. A conduit member 80 defines a conduit 82 connecting the upper, water chamber 76 with the outlet orifice 72.

A valve assembly 84 within the case 62 includes a float element 86 having a continuous outermost surface of constant diameter, with a first valve element 88 mounted thereupon, the float element and valve element being adapted for movement between a first position and a second position in response to differential of pressure between the inlet 70 and water chamber 76. In the first position (shown), the first valve element is in engagement with a first valve seat 89 defined by the conduit member 80 for restricting flow of water from the water chamber into the conduit 82. In the second position, the first valve element 88 is spaced from engagement with the first valve seat 89 to permit flow of water from the water chamber into the conduit.

A check valve assembly 90, which permits flow of water in a direction from the inlet 70 toward the water chamber 76 and restricts flow of water in the opposite direction, includes a check valve element 92 mounted upon the float element 86. (In the preferred embodiment, the check valve element is a resilient element extending radially from the outermost continuous surface of the float element about.)

Figure 3A:
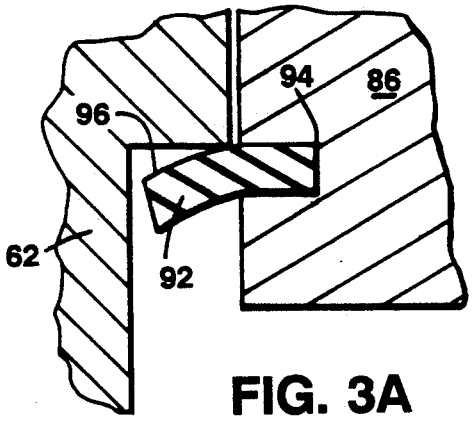
FIG. 3A is an enlarged sectional view taken at the circle 3A—3A of FIG. 3.

Referring also to FIG. 3A, the case 62 defines a radially inwardly extending check valve seat 94, and the check valve element 92 defines an opposed check surface 96 disposed for sealing engagement with the check valve seat when the first valve element 88 (mounted upon the float element 86) is in a second position, spaced from sealing engagement with the valve seat 89 to allow flow of water into the conduit 82. When the first valve element 88 is in a first position, the check surface 96 is spaced from engagement with the check valve seat 94 and permits flow of water from the inlet, around the float element 86, into the chamber 76.

The case 62 similarly defines an orifice 98 connecting the outlet conduit 82 to the exterior of the trap primer valve 60 in a manner to prevent siphon of fluid 8 from the sewer drain trap 4 into the conduit.

Figure 4:
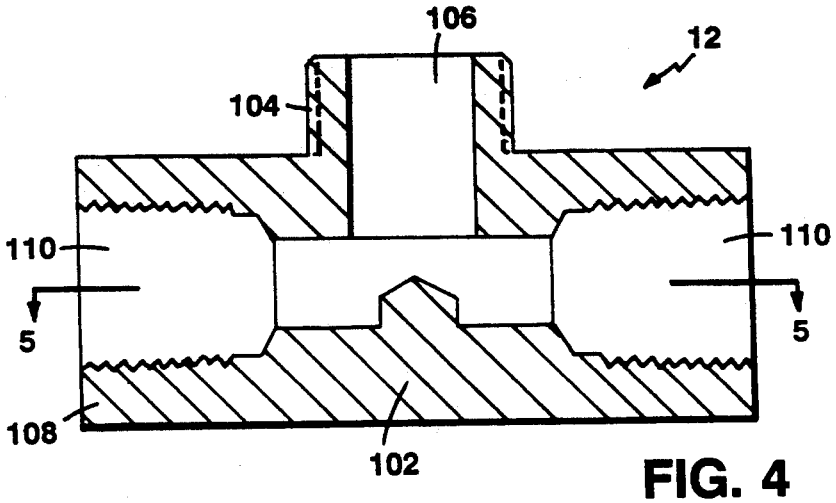
FIG. 4 is a side sectional view of a multi-port adapter of the invention.
Figure 5:
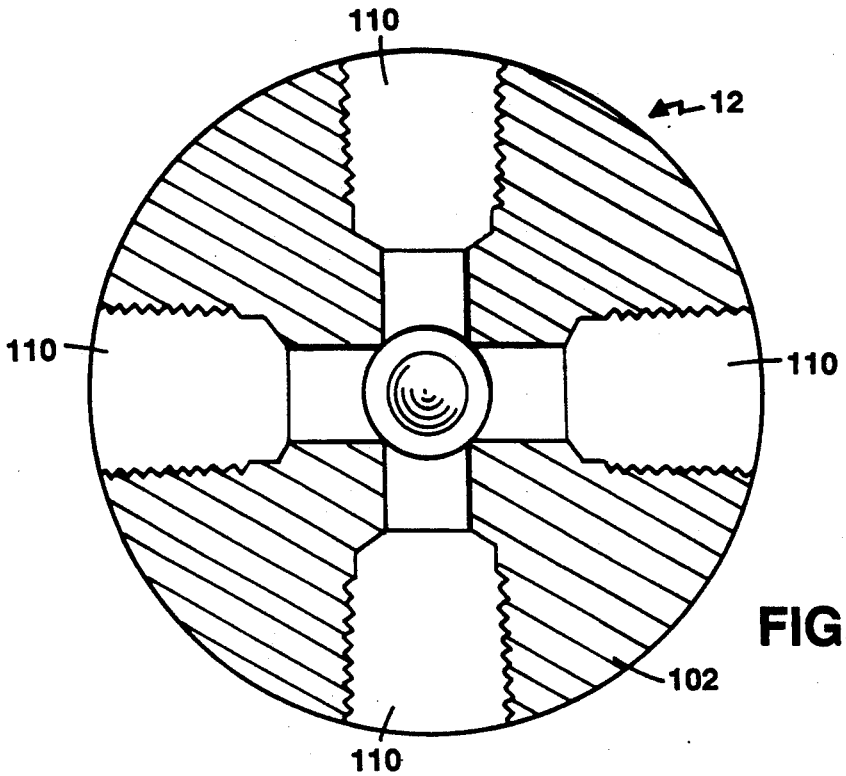
FIG. 5 is a top sectional view of the multi-port adapter taken at the line 5—5 of FIG. 4.

Referring to FIGS. 4 and 5 (and also with reference to FIGS. 1 and 3), the multi-port adapter 12 for use with a sewer drain trap primer valve, e.g. of the invention, and multiple sewer drain traps 4 includes a body 102 having an upper portion 104 defining an inlet orifice 106 for communication with a sewer drain trap primer valve 10, 60 and a lower portion 108 defining a plurality of outlets 110, each outlet adapted for communication with a sewer drain trap 4.

Referring again to FIG. 1, the automatic sewer drain trap primer valve 60, equipped with a multi-port adapter 12, is also installed as in a conduit 14 between domestic piping 16 providing a source of pressurized water and a sewer drain trap 4.

The pressure of water entering the valve casing 62 from inlet 70 displaces the float element 86, causing the first valve element 88 to sealingly engage upon the first valve seat 89. The pressure of water within the chamber 76 also acts upon the flexible diaphragm 74 to pressurize the sealed volume of air within the chamber 78.

When pressure in the domestic piping 16 (and in the inlet 70 to the valve 60) is reduced, e.g. when a faucet is opened, the pressurized air within chamber 78 expands and displaces the flexible diaphragm 74 toward the water chamber 76. This displacement of the diaphragm 74 also causes upward displacement of the float element 86. Referring also to FIG. 3A, as a result of upward movement of the float element 86 and the check valve element 92, the check surface 96 is brought into sealing engagement upon the check valve seat 94 defined by the case 62.

Displacement of the float element 86 removes first valve element 88 from engagement with first valve seat 89, allowing water to flow from the chamber 76 into the conduit 82, and then on through the multi-port adapter 12 to charge one or more sewer drain traps 4 connected to the adapter outlets 110.

When pressure in the chamber 76 falls below the pressure at the inlet 70, the float element is again displaced downward, causing the first valve element 88 to once again engage upon seat 89 to close the conduit 82, and water from the inlet flows around the float element 86 and through check valve assembly 90 to recharge the chamber 76.

This process is repeated automatically with each reversal of the pressure differential across the float element 86 to maintain the desired level of water within the sewer drain traps 4. The domestic water supply piping 16 is protected against contamination since flow from the inlet 70 into the chamber 74 is permitted only when flow into conduit 82 is sealed by first valve element 88, and since flow from the chamber 76 into the conduit 82 is permitted only when the check valve assembly 90 is closed to prevent flow from the inlet. Also, the check valve assembly 90 serves to restrict backflow from the chamber 76 toward the inlet 70, and the orifice 96 acts to prevent backflow from the sewer drain traps 4 into the valve 60, as might occur due to siphoning in the event of sudden loss of supply pressure.

Other embodiments of the invention are within the following claims. For example, in a sewer drain trap primer valve of the type shown in FIG. 3, the float element 86, and the check valve assembly 90 mounted thereon, may be biased toward the position of FIG. 3A, e.g. by a spring (similar to spring 58 of the embodiment of FIG. 1).

Also, the pressure of air sealed within chamber 42 (FIG. 2) and chamber 78 (FIG. 3) may be precharged to a pressure above atmospheric, e.g. as described above with reference to FIG. 2, or the pressure of air within the chamber of either embodiment may begin at atmospheric pressure, or below atmospheric pressure.

What is claimed is:

1. A sewer drain trap primer valve comprising a case defining a volume, said case having an upper end and a lower end, said upper end defining an inlet orifice for communication of the volume with a source of domestic water, said lower end defining an outlet orifice for communication of the volume with a sewer drain trap, a flexible diaphragm separating said volume into an upper, water chamber and a lower, sealed, air chamber, a conduit member defining a conduit connecting said upper, water chamber with said outlet orifice, said conduit member defining a first valve seat, a valve assembly comprising a float element, with a first valve element mounted thereupon, said float element having a continuous outermost surface of a constant diameter and being adapted for movement between a first position and a second position in response to differential of pressure between said inlet and said water chamber, in said first position, said first valve element being in engagement with said first valve seal for restricting flow of water from said water chamber into said conduit, and in said second position, said first valve element being spaced from engagement with said first valve seat to permit flow of water from said water chamber into said conduit, and a check valve adapted to permit flow of water in a direction from said inlet toward said water chamber and to restrict flow of water in a direction from said water chamber toward said inlet, said check valve comprising a check valve element mounted upon said float element, said case including a radially inwardly extending check valve seat, and said check valve element defining a check surface disposed for sealing engagement with said radially inwardly extending check valve seat when said first valve element mounted upon said float element is in a second position, said check surface being spaced from engagement with said radially inwardly extending check valve seat when said first valve element mounted upon said float element is in a first position, said check valve element comprising a resilient member extending radially from said outermost continuous surface of said float element.

2. The sewer drain trap primer valve of claim 1 wherein a volume of air within said lower, sealed air chamber is at an initial predetermined pressure other than atmospheric pressure.

3. The sewer drain trap primer valve of claim 2 wherein said initial predetermined pressure is greater than atmospheric pressure.

4. The sewer drain trap primer valve of claim 1 wherein said case defines an orifice connecting said conduit to the exterior of said case in a manner to prevent siphon of fluid from said sewer drain trap into said conduit.

5. A sewer drain trap primer valve as defined in claim 1, wherein said flexible diaphragm has an outer edge portion fixedly attached to said case between said upper end and said lower end.

* * * * *

UNITED STATES PATENT AND TRADEMARK OFFICE

CERTIFICATE OF CORRECTION

PATENT NO. : 5,287,877

DATED : February 22, 1994

INVENTOR(S) : Rand H. Ackroyd

It is certified that error appears in the above-identified patent and that said Letters Patent is hereby corrected as shown below:

Col. 7, line 8, delete "about".

Signed and Sealed this

Fourth Day of July, 1995

Bruce Lehman

*Attest:*

BRUCE LEHMAN

*Attesting Officer*

*Commissioner of Patents and Trademarks*